US005305482A

United States Patent [19]

Dewert

[11] Patent Number: 5,305,482

[45] Date of Patent: Apr. 26, 1994

[54] LIFTING DEVICE

[75] Inventor: Eckhart Dewert, Enger, Fed. Rep. of Germany

[73] Assignee: Dewert Antriebs-und Systemtechnik GmbH & Co KG, Kirchlengersn, Fed. Rep. of Germany

[21] Appl. No.: 872,968

[22] Filed: Mar. 24, 1992

[30] Foreign Application Priority Data

Mar. 28, 1991 [DE] Fed. Rep. of Germany ... 9103817[U]

[51] Int. Cl.[5] ..... A61G 7/06

[52] U.S. Cl. ..... 5/616; 5/611; 5/617

[58] Field of Search ..... 5/611, 616, 617, 634; 254/7 R, 7 B, 7 C, 98

[56] References Cited

U.S. PATENT DOCUMENTS

| | | | |
|---|---|---|---|
| 1,336,294 | 4/1920 | Hackman | 5/634 |
| 2,521,214 | 9/1950 | Goeller | 254/7 C |
| 3,277,501 | 10/1966 | Frisz et al. | 5/617 |
| 3,373,453 | 3/1968 | Goodman | 5/611 |
| 3,472,183 | 10/1969 | Goodman | 5/611 X |
| 4,853,990 | 8/1989 | Elder et al. | 5/634 |

*Primary Examiner*—Michael F. Trettel
*Attorney, Agent, or Firm*—Michael J. Striker

[57] ABSTRACT

A lifting device for turnable parts of a furniture article has a scissors-type element, an electric motor actuating the scissors-type element and having a driven member formed as a rotatable nut, and a stationary threaded spindle on which the electric motor is displaceable.

21 Claims, 3 Drawing Sheets

LIFTING DEVICE

BACKGROUND OF THE INVENTION

The present invention relates to a lifting device for turnable parts of furniture articles.

More particularly, it relates to a lifting device for turning of heads and/or foot parts of a lattice furniture article.

For turning such parts of furniture articles many various frame structures are known. The frame structures are provided with an arresting toothing and a supporting lever which, depending on the angle of inclination, engages in a respective arresting element. Depending on the distance of the arresting element, steps between the individual angles of inclinations are produced. Therefore the known frame structures are not suitable for a stepless adjustment of the parts of the furniture articles to be turned. Moreover, the parts can be turned only manually. It is furthermore also disadvantageous that they can be turned back then to the stretched position when they are turned first to a greater angular position. The reason is that the frame structures are designed so that then the supporting lever can slide along the arresting elements. Moreover, these known frame structures are not suitable to equip for example available lattice articles.

SUMMARY OF THE INVENTION

Accordingly, it is an object of the present invention to provide a lifting device which avoids the disadvantages of the prior art.

More particularly, it is an object of the present invention to provide a lifting device which can be added to available articles of furniture provided with turnable parts.

Furthermore, it is also an object of the present invention to provide a lifting device which is simple to operate and ensures a stepless adjustment of the articles of furniture provided with such a device.

It is also an object of the present invention to provide such a lifting device that the article of furniture can be turned back from each angular position in the extended condition.

In keeping with these objects and with others which will become apparent hereinafter, one feature of the present invention resides, briefly stated, in a lifting device for turnable part of a furniture article which has a lifting scissors-type element, and a low voltage direct current gear motor which actuates the scissors-type element and has a driven member formed as a rotatably driveable inner thread nut, and a stationary threaded spindle on which the low voltage direct current gear motor is movable.

The inventive lifting device provides a stepless adjustment of the turnable part of a furniture article, by cooperation of the scissors-type element with the low voltage direct current gear motor. Moreover, the adjustment is extremely quiet since only the gear motor is to be turned on. With suitable structural elements, the ends of the scissors arms of the scissors-type element are mounted on the structural parts of the part of the furniture article to be turned. Since the low voltage direct current gear motor is a rotary direction-reversible motor, the part of the furniture article to be turned can therefore be turned from each angular position in a stretched or flat position. The inventive lifting device is suitable for the self-mounting.

The mounting of the low voltage direct current gear motor and the threaded spindle is especially simple when the scissors-type element has a fixed and a steplessly adjustable wing, and the ends of one side of the scissors arms of the scissors-type element are rotatably supported on both wings, while each opposite end of the scissors arms is displaceable on the associated wing. Moreover, the lifting device can be mounted in an especially simply manner on the available and previously manufactured articles of furniture. Since the low voltage direct current gear motor displaces on the threaded spindle after turning on and thereby actuates the scissors-type element through suitable connecting parts, it is especially favorable structurally when the stationary threaded spindle is located parallel and at a certain distance from the wings of the scissors-type element.

The mounting of the threaded spindle is especially simple when it carries at one end a fork head articulately connected with an angled lever fixed with one scissors arm, and the low voltage direct current gear motor is arranged in the opposite region of the stationary spindle. Advantageously, the low voltage direct current gear motor is supported in a fork which has a beam mounted on one scissors arm. Thereby during the movement of the low voltage direct current gear motor favorable conditions for the force transmission to the scissors arm are provided, since the beam is mounted in the region of one end of the associated scissors arm. A mounting favorable and service favorable design is obtained when the fork head is formed of two levers which are connected with one another and curved correspondingly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 4*a* and 4*b* are a side view and an end view of a threaded nut.

DESCRIPTION OF THE PREFERRED EMBODIMENT

Figure 1:
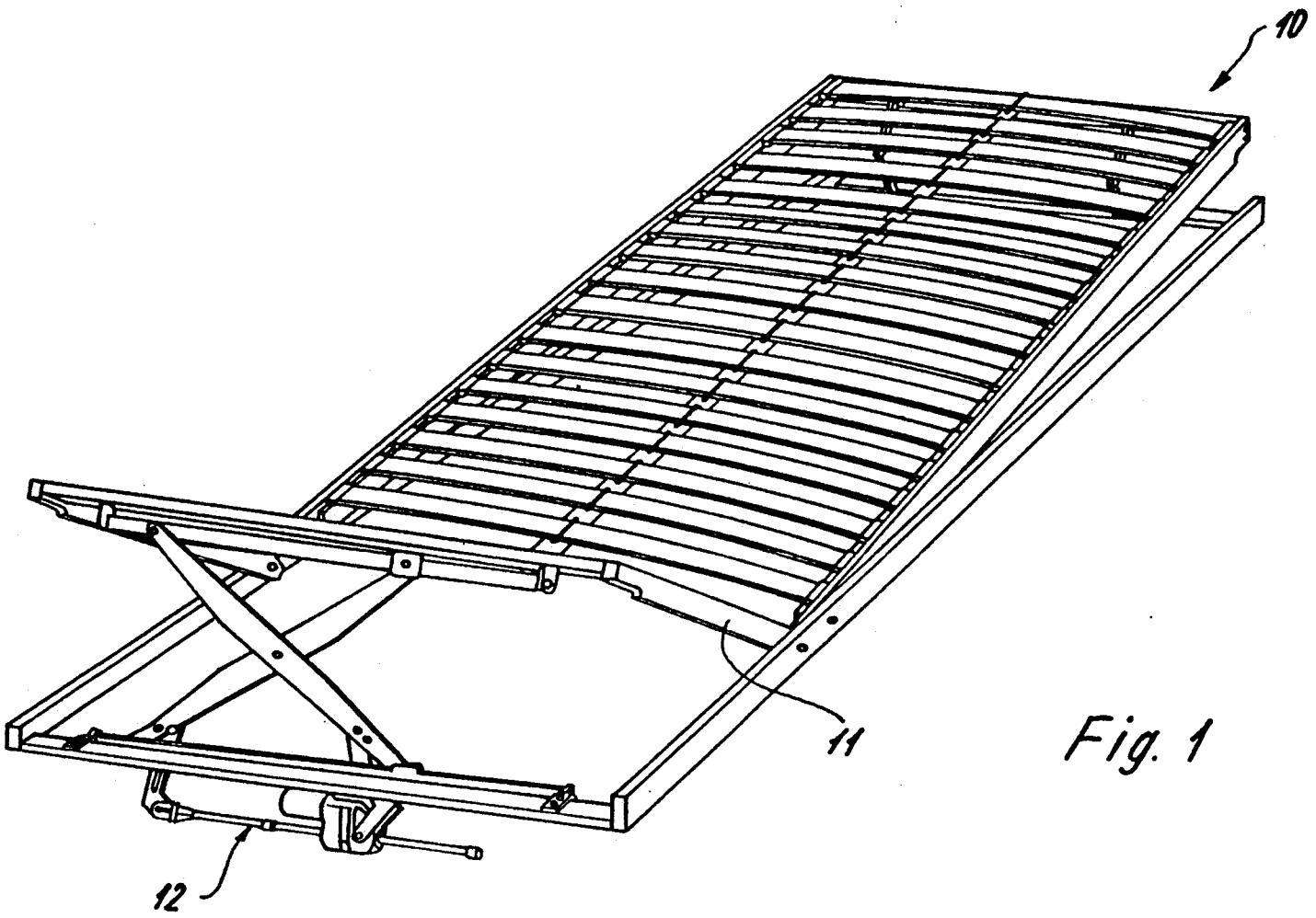
FIG. 1 is a perspective view of a lattice article with a lifting device in accordance with the present invention.
Figure 2:
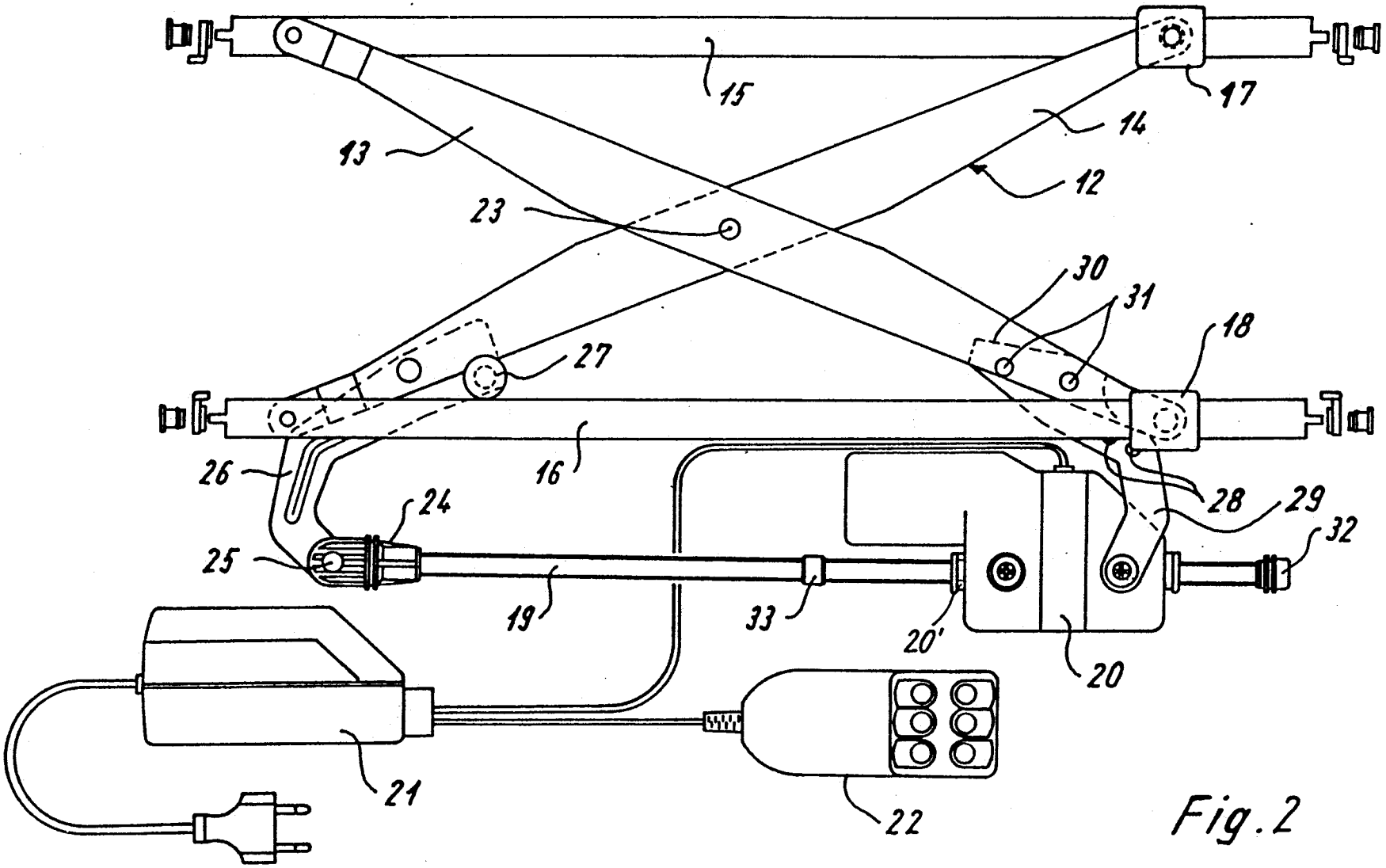
FIG. 2 is a view showing the lifting device of FIG. 1.

A lattice article 10 is identified in FIG. 1 as a whole with reference numeral 1. It has a head part 11 which is turnable about a horizontal axis. The head part 11 is turnable by a lifting device 12 shown in FIG. 2. A piece of the lattice article which extends from the head part 11 to the foot 10 is also turnable in the shown embodiment about a horizontal axis.

Figure 3:
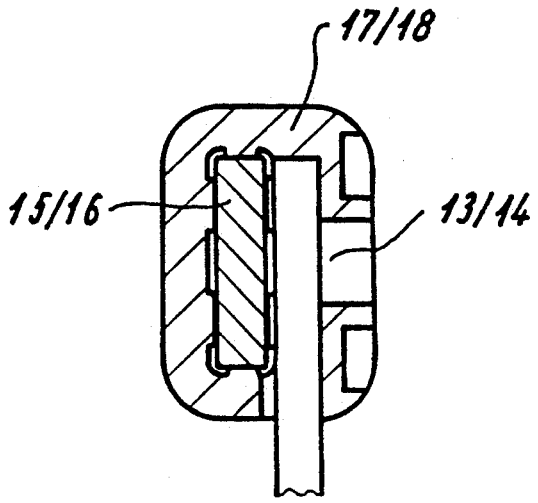
FIG 3 is a view showing a detail of FIG. 2 in section, to illustrate the arrangement of a sliding piece on a scissors arm.

The lifting device 12 has a scissors-type element including two scissors arms 13 and 14 and two wings 15 and 16. The left ends of the scissors arms 13 and 14 are rotatably supported on the wings 15 and 16. The bearing points are located in the end regions. The opposite ends of the scissors arms 13 and 14 are rotatably supported on sliding members 17 and 18. The sliding members 17 and 18 are displaceable on the wings 15 and 16, so that the wings 15 and 16 are actually formed as guiding rods. As shown in FIG. 3, first the sliding member 17 and 18 is premounted on the associated scissors arm 13 or 14. The respective wing 15 and 16 is later inserted and has a relatively small gap with respect to the associated scissors arm 13 and 14. Due to this advantageous design the scissors type element is especially stable since only low tilting moments can occur.

The lifting device also has a threaded spindle 19 which extends parallel to and at a distance from the wings 15 and 16. A low voltage direct current gear motor is arranged on the threaded spindle 19. The threaded spindle 19 is held in a non-turnable manner. The lifting device also has a power unit 21 formed so that the lifting device 12 can be supplied with current from a conventional network. The power unit 21 produces a required rectified low voltage from the network voltage. The current supply to the low voltage direct current gear motor is performed through a conventional cable. For turning on and turning off of the low voltage direct current gear motor, a hand switch 22 is provided. It is not explained in detail since it is conventional.

Both scissors arms 13 and 14 are rotatably supported on a scissors pin 24 located centrally. During the use of the lifting device 12 for the lattice article 10, the lower wing 16 is associated with a transverse wing of the frame, while the upper wing 15 is associated with tho outer transverse wing of the adjustable head part 11. In the mounted position the wings 15 and 16 extend horizontally. It can be seen from FIG. 2 that the fork head 24 is non-rotatably arranged on the left end of the threaded spindle 19. An angle lever 26 is fixed in the fork head 24 by a pin 25. The angle lever is formed as a two-armed lever, since it is rotatably supported in the end region of the scissors arm 14. A force transmitting roller 27 is arranged on the angle lever 26 in the region of the end facing away of the fork head 24. The force transmitting roller 27 engages the scissors arm 124 and contacts the surface associated with the threaded spindle 19. The force transmitting roller 27 acts only in a lifting direction. In the lowering direction it cannot pull together the scissors whereby a squeezing danger is avoided.

The low voltage direct current gear motor 20 is suspended on the associated end of the scissors arm 13 by a fork. The fork includes two band levers which are connected with one another by screws 28. The lever shown in the drawings is identified with reference numeral 29. The other lever has screw holes in its end region. As can be seen from FIG. 2, the lever 29 is designed so that a beam 30 is formed for the fork. The beam 30 is mounted on the associated end of the scissors arm 13 by two rivets 31. A closing cap 32 is arranged on the threaded spindle 19 at the end facing away of the fork head 24 and simultaneously limits the movement of the low voltage direct current gear motor 20 to the right.

An abutment 33 is provided in the central region of the threaded spindle 19 and limits the movement of the low voltage direct current gear motor 20 to the left. The abutment 33 is displaceable on the spindle 19 with a certain force. Thereby a variable adjustment height of the scissors type element of the lifting device 12 is provided.

The housing of the low voltage direct current gear motor 20 is formed as a two-part housing with a motor receptacle composed of a special synthetic plastic material. The motor has an internally threaded nut 20'. The internally threaded nut 20' forms a driven member of the motor and is turned during the turning-on of the motor. This shaft nut can have an outer toothing. The end switches for limiting the movement of the low voltage direct current gear motor are integrated in the housing and actuated when the closure cap 32 or the abutment 33 is contacted. When the lifting device 12 is used with a lattice article 10 the wings 15 and 16 are connected with the wings of the frame or the lattice article by mounting angles.

As can be seen from the drawing, the mounting of the lifting device 12 by a manufacturer is extremely simple. It requires the operation of the stationary threaded spindle 19, the angle lever 26 and the fork which has the lever 28. Due to its simple construction the hole drive is premounted with the wing 15 in the advantageous manner by the lattice article producer and then folded for storage and transportation under the lattice article 10. The motor with the transmission and spindle 19 are not thicker than the lattice article 10 so that the conventional transportation and storage sizes are not affected.

In order to spread the wings 15 and 15, the low voltage direct current gear motor 20 is turned on and moved on the stationary threaded spindle 19 in direction to the fork head 24. Thereby the right ends of the scissors arms 13 and 14 are displaced in direction to the fork head 24 since the lever 28 takes along the scissors arm 13 in connection with the beam 30. Simultaneously the fork head 24 displaces in direction toward the low voltage direct current gear motor 20, conditional to the adjusting equilibrium of the forces. Thereby the force transmitting roller 27 maintains a constant contact with the scissors arm 14 and particularly with its surface facing toward the threaded spindle 19. Therefore the erecting movement of the lifting device 12 is further supported. The collapsing of the wings 15 and 16 of the lifting device 12 is performed by reversing of the low voltage direct current gear motor 20. Thereby due to weight of the lifting device 12 the contact between the surface of the scissors arm 14 and the force transmitting roller 27 is maintained. Since it operates only in the lifting direction, it cannot pull the scissors in the lowering direction and therefore the danger of squeezing is avoided.

The housing of the power unit 21 is composed of two parts. The power unit 21 contains a transformer and a control plate. It can also be designed for remote control operation. The actuating part or the switch 22 is formed as a head switch. It is however recommended to provide a remote control receiver which reacts to radial or infrared signals. Also, an electronic switching device is desirable, for example for demonstration in a show window with an endurance run operation.

It will be understood that each of the elements described above, or two or more together, may also find a useful application in other types of constructions differing from the types described above.

While the invention has been illustrated and described as embodied in a lifting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A furniture article, comprising a furniture article unit with turnable parts; and a lifting device for said turnable parts of said furniture article unit, said lifting device including a scissors-type element mountable directly on said furniture article unit, means for mounting said scissors-type element directly on said furniture article unit, an electric motor actuating said scissors-type element and having a driven member formed as a rotatable nut, and a stationary threaded spindle on which said electric motor is displaceable.

2. A furniture article as defined in claim 1, wherein said motor is a low voltage direct current gear motor.

3. A furniture article as defined in claim 1, wherein said nut is formed as an internally threaded nut.

4. A furniture article as defined in claim 1, wherein said electric motor is displaceable on said threaded spindle to a center of said threaded spindle.

5. A furniture article as defined in claim 1, wherein said driven member formed as a nut is externally threaded.

6. A furniture article as defined in claim 1; and further comprising a power unit connectable with an electrical network.

7. A furniture article as defined in claim 6, wherein said power unit has at least one terminal for its operation.

8. A furniture article as defined in claim 1; and further comprising an actuating element to be actuatable by a user for actuating the lifting device.

9. A furniture article as defined in claim 8, wherein said actuating element is a hand switch.

10. A furniture article as defined in claim 1, wherein said scissors-type element, said electric motor and said threaded spindle have a width such that for storage and transportation of a furniture article provided with the lifting device they are foldable underneath the furniture element and do not increase its width.

11. A lifting device for turnable parts of a furniture article, comprising a scissors-type element; an electric motor actuating said scissors-type element and having a driven member formed as a rotatable nut; and a stationary threaded spindle on which said electric motor is displaceable, said scissors-type element having a steplessly displaceable wing and a stationary wing, and two scissors arms, said scissors arms having first ends rotatably supported on said wings and second ends displaceably guided on said wings.

12. A lifting device as defined in claim 11, wherein said threaded spindle extends parallel to and at a distance from said wings.

13. A lifting device as defined in claim 11, wherein said threaded spindle has an end associated with said first ends of said scissors arms and provided with a fork head; and further comprising an angle lever pivotally connected with said end and rotatably supported on one of said scissors arms.

14. A lifting device as defined in claim 13, wherein said electric motor is arranged on said threaded spindle in a region of the threaded spindle which faces away of said fork head.

15. A lifting device as defined in claim 13, wherein said threaded spindle has an end facing away of said fork head and provided with a closure cap and a center region provided with an abutment for actuating said electric motor when said closure cap or said abutment is contacted.

16. A lifting device as defined in claim 15, wherein said abutment is displaceable so as to change an adjustment height of said scissors-type element.

17. A lifting device as defined in claim 13, wherein said angle lever has an end facing away of said fork head and provided with a force transmitting roller, said roller engaging one of said scissors arms and contacting a surface facing said threaded spindle.

18. A lifting device as defined in claim 17, wherein said force transmitting roller is arranged so that it applies a force only during spreading of said scissors type element.

19. A lifting device as defined in claim 11, wherein said second ends of said scissors arms are provided with sliding members formed as flat members for relatively low tilting moments and stabilization of said scissors element, said sliding members being arranged so that a small gap is maintained between said sliding members and said scissors arms.

20. A lifting device for turnable parts of a furniture article, comprising a scissors-type element; an electric motor actuating said scissors-type element and having a driven member formed as a rotatable nut; a stationary threaded spindle on which said electric motor is displaceable; and a fork on which said electric motor is suspended, said fork having a beam which is fixed on one of said scissors arms.

21. A lifting device as defined in claim 20; and further comprising a lever, said beam being formed as an end of said lever which faces away of said electric motor, said lever being composed of two bent lever members which are connected with one another.

* * * * *